US009267209B2

(12) United States Patent
Knoeppel et al.

(10) Patent No.: US 9,267,209 B2
(45) Date of Patent: Feb. 23, 2016

(54) SACRIFICIAL ANODE CONTROL

(71) Applicant: A. O. Smith Corporation, Milwaukee, WI (US)

(72) Inventors: Ray Oliver Knoeppel, Hartland, WI (US); Yao Zhen Hu, Nanjing (CN); Russell Banks, Milwaukee, WI (US); Brian T. Branecky, Oconomowoc, WI (US)

(73) Assignee: A. O. SMITH CORPORATION, Milwaukee, WI (US)

( * ) Notice: Subject to any disclaimer, the term of this patent is extended or adjusted under 35 U.S.C. 154(b) by 363 days.

(21) Appl. No.: 13/838,954

(22) Filed: Mar. 15, 2013

(65) Prior Publication Data

US 2014/0262822 A1 Sep. 18, 2014

(51) Int. Cl.

| | |
|---|---|
| ***C23F 13/00*** | (2006.01) |
| ***C23F 13/04*** | (2006.01) |
| ***C23F 13/22*** | (2006.01) |
| ***F24H 9/00*** | (2006.01) |
| ***F24H 9/20*** | (2006.01) |

(52) U.S. Cl.

CPC ..... *C23F 13/04* (2013.01); *C23F 13/22* (2013.01); *F24H 9/0047* (2013.01); *F24H 9/2021* (2013.01)

(58) Field of Classification Search

CPC ..... C23F 13/04; C23F 13/22; C23F 2213/10; C23F 2213/11; F24H 9/0047

USPC ..... 204/196.02, 196.03, 196.06, 196.37

See application file for complete search history.

(56) References Cited

U.S. PATENT DOCUMENTS

| | | | | |
|---|---|---|---|---|
| 3,037,920 | A | 6/1962 | Vixler | |
| 3,657,084 | A | 4/1972 | Beer et al. | |
| 3,860,787 | A | 1/1975 | Strobach | |
| 3,956,095 | A * | 5/1976 | Khoo et al. | 204/196.1 |
| 4,407,711 | A | 10/1983 | Baboian et al. | |
| 6,183,625 | B1 | 2/2001 | Staerzl | |
| 2006/0083491 | A1 * | 4/2006 | Knoeppel et al. | 392/338 |

FOREIGN PATENT DOCUMENTS

| | | |
|---|---|---|
| JP | 62290889 | 12/1987 |

OTHER PUBLICATIONS

Corr-Rad (Cathodic Protection Systems Design, 2011, http://web.archive.org/web/20110606180556/http://www.corr-rad.com/design.html).*

(Continued)

*Primary Examiner* — Luan Van
*Assistant Examiner* — Alexander W Keeling
(74) *Attorney, Agent, or Firm* — Michael Best & Friedrich LLP

(57) ABSTRACT

Systems and methods are described for controlling the current of a sacrificial anode based on the conductivity state of the water. An unregulated current of the sacrificial anode relative to the water tank is measured and a conductivity state of the water is identified based on the measured unregulated current. A maximum current limit for the sacrificial anode is determined based on the conductivity state of the water and the current of the sacrificial anode is limited such that the current does not exceed the determined maximum current limit.

13 Claims, 5 Drawing Sheets

(56) References Cited

OTHER PUBLICATIONS

Australian Government Department of Education, Employment and Workplace Relations (referred to as a DEEWR, Cathodic Protection, 2008 https://nationalvetcontent.edu.au/alfresco/d/d/workspace/SpacesStore/50f126e2-c01a-472f-b07b-4c52fa0025f3/ims/typeAappliances/storage_water_heaters/cathodic.html).*

* cited by examiner

| | Water Temperature | | |
|---|---|---|---|
| **Water Conductivity** | 100 Degrees F | 120 Degrees F | 140 Degrees F |
| Low (~90 uS/cm) | I < 5.5 mA | I < 7.1 mA | I < 8.7 mA |
| Moderate (~350 uS/cm) | 5.5 mA < I < 8.5 mA | 7.1 mA < I < 10.9 mA | 8.7 mA < I < 13.2 mA |
| High (~1500 uS/cm) | 8.5 mA < I | 10.9 mA < I | 13.2 mA < I |

SACRIFICIAL ANODE CONTROL

BACKGROUND

The invention relates to tank-based water heating systems that include a sacrificial anode to limit the amount of corrosion of the tank.

SUMMARY

Because water heater tanks are typically made of metal, the material can react with the water stored in the tank resulting in corrosion of the metal and, eventually, failure of the tank. Mechanisms for limiting this type of corrosion include lining the tank with a non-corrosive material such as glass. Some water heating systems also include a sacrificial anode to limit corrosion of the tank material. The sacrificial anode reacts with the water to cause a current to flow through the anode and the tank. This chemical reaction causes the sacrificial anode to degrade instead of corroding the metal material of the water tank walls.

The level of protection provided by the sacrificial anode increases with the current of the sacrificial anode relative to the tank walls. However, an increased current also causes the sacrificial anode to degrade more rapidly. The current of the sacrificial anode, the rate of anode degradation, and the ability of the anode to protect the tank material is dependent upon multiple variable conditions including the conductivity of the water in the tank.

In one embodiment, the invention provides a method for controlling the current of a sacrificial anode based on the conductivity state of the water. An unregulated current of the sacrificial anode relative to the water tank is measured and a conductivity state of the water is identified based on the measured unregulated current. A maximum current limit for the sacrificial anode is determined based on the conductivity state of the water and the current of the sacrificial anode is limited such that the current does not exceed the determined maximum current limit.

In some embodiments, the conductivity state is determined by identifying a first current threshold and a second current threshold in a look-up table stored on a memory that correspond to a temperature of the water in the tank. The measured unregulated current of the anode is compared to the first and second current thresholds. If the measured unregulated current is less than both thresholds, the conductivity state of the water is determined to be low. If the measured unregulated current is between the two thresholds, the conductivity state is determined to be moderate. If the measured unregulated current is greater than both thresholds, the conductivity state is determined to be high.

In some embodiments, the first and second current thresholds are selected from the look-up table based on water temperature, the geometry of the water tank (as identified by a product model number), and the geometry/chemistry of the anode (as identified by a product model number).

In some embodiments, the determined maximum current limit corresponds to a minimum current required to protect the water tank from corrosion multiplied by a safety factor. In some embodiments, it is determined whether an odor reduction mode of the water heater is activated and, when the odor reduction mode is activated, the determined maximum current limit is reduced to a value less than the original determined maximum current limit, but greater than or equal to the minimum current required to protect the water tank from corrosion.

In some embodiments, degradation of the water tank is periodically evaluated. A subsequent unregulated current of the anode is measured and compared to the original unregulated current value. The determined maximum current limit is increased when the difference between the initial unregulated current value and the subsequent unregulated current value exceeds a degradation threshold.

In another embodiment, the invention provides a water heating system including a water tank, a sacrificial anode, and a water heater controller. The water heater controller measures an unregulated current of the sacrificial anode relative to the water tank and identifies a conductivity state of the water in the water tank based on the measured unregulated current. A maximum current limit for the sacrificial anode is determined based on the conductivity state and the current of the sacrificial anode is limited so that the current does not exceed the determined maximum current limit.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
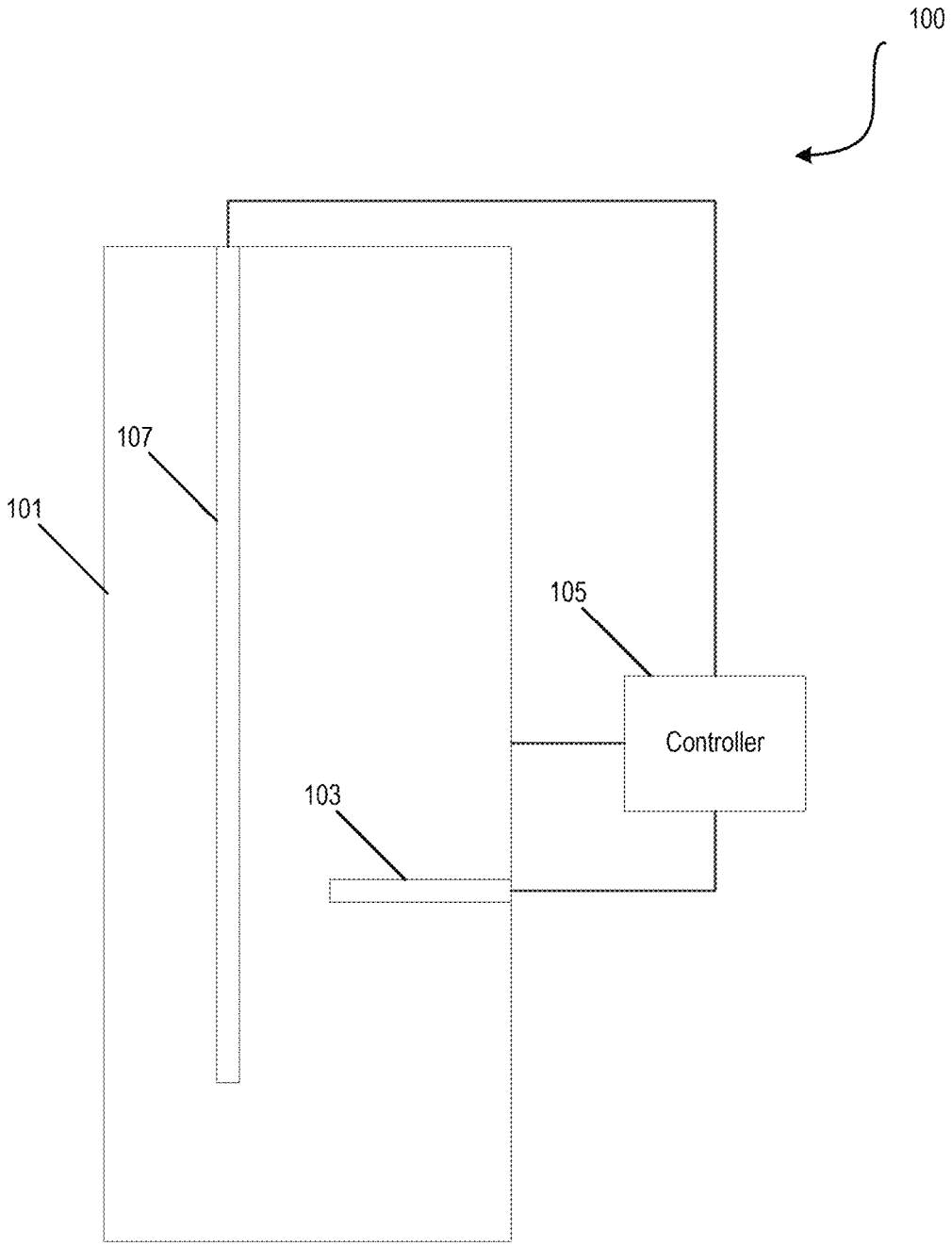
FIG. 1 is a block diagram of a tank-based water heating system according to one embodiment.

FIG. 1 illustrates a water heating system 100 that includes a water tank 101 and an electric heating element 103 such as, for example, a resistive heating element. The water tank 101 is constructed of a metallic material and lined with glass. A water heater controller 105 operates the electric heating element 103 to heat the water in the water tank 101. In some alternative constructions, the electrical heating element 103 is replaced with a gas heating apparatus including a gas valve that is controlled by the water heater controller 105 to regulate the temperature of the water in the water tank 101. The controller 105 can be mounted to the water tank 101 or located remotely. The water heating system 100 also includes a sacrificial anode 107 positioned within the water tank 101. The sacrificial anode 107 reacts with the water in the tank 101 to apply a current on the sacrificial anode 107 relative to the water tank 101. This reaction also prevents corrosion of the metal of the water tank 101.

Figure 2:
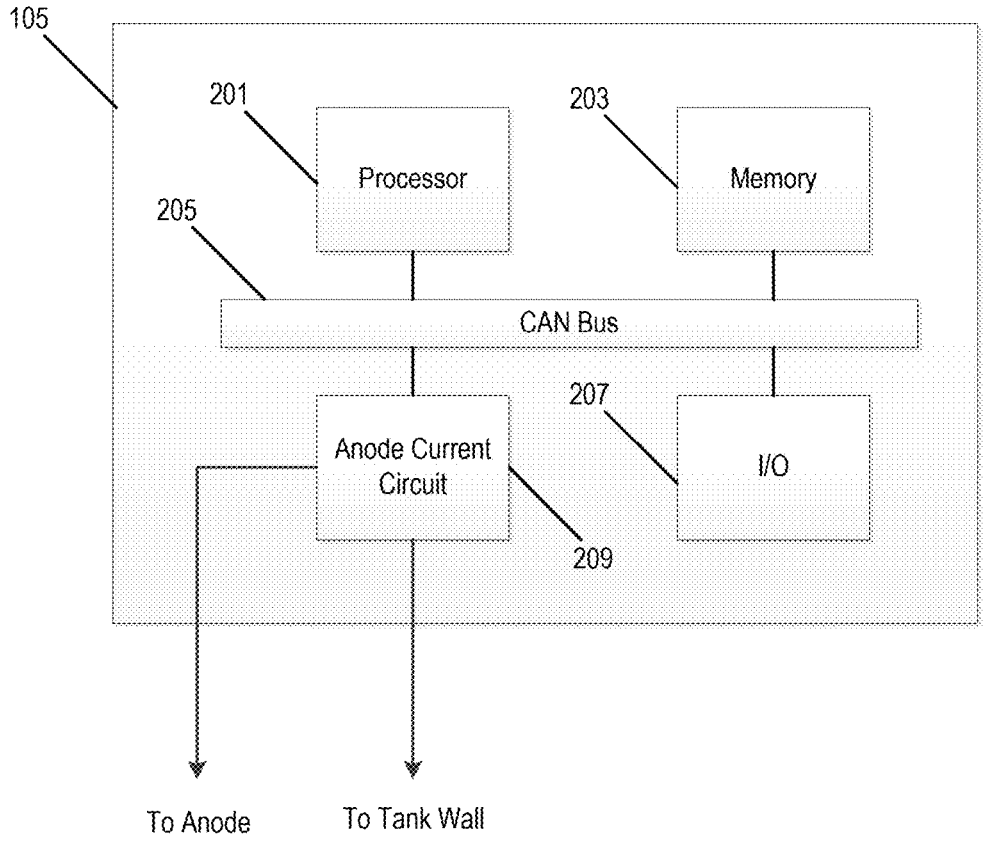
FIG. 2 is a block diagram of a water heater controller of the water heating system of FIG. 1.

FIG. 2 illustrates the water heater controller 105 in further detail. The controller 105 includes a combination of hardware and software components. The controller 105 includes a printed circuit board ("PCB") that is populated with a plurality of electrical and electronic components that provide power, operational control, and protection to the water heating system 100. In the example of FIG. 2, the PCB includes a processor 201 (e.g., a microprocessor, a microcontroller, or another suitable programmable device or combination of programmable devices), a memory 203, and a controller-area network bus ("CAN bus") 205. The CAN bus 205 connects various components of the PCT including the memory 203 to the processor 201. The memory 205 includes, for example, a read-only memory ("ROM"), a random access memory ("RAM"), an electrically erasable programmable read-only memory ("EEPROM"), a flash memory, a hard disk, or another suitable magnetic, optical, physical, or electronic memory device. The processor 201 is connected to the memory 203 and executes software instructions that are capable of being stored in the RAM (e.g., during execution), the ROM (e.g., on a permanent basis), or another non-transitory computer readable medium such as another memory or disc. Additionally or alternatively, the memory 203 is included in the processor 201. The controller 105 also includes an input/output ("I/O") system 207 that includes routines for transferring information between components within the controller 105 and other components of the water heating system 100. For example, the I/O system 207 can communicate with a user interface of the water heating system 100.

Software included in the implementation of the water heating system 100 is stored in the memory 203 of the controller 105. The software includes, for example, firmware, one or more applications, program data, one or more program modules, and other executable instructions. The controller 105 is configured to retrieve from memory and execute, among other things, instructions related to the control processes and methods described herein.

The PCB of the controller 105 also includes, among other things, a plurality of additional passive and active components such as resistors, capacitors, inductors, integrated circuits, converters, and amplifiers. These components are arranged and connected to provide a plurality of electrical functions to the PCB including, among other things, filtering, signal conditioning, signal converter, and voltage regulation. For descriptive purposes, the PCB and the electrical components populated on the PCB are collectively referred to herein as the controller 105.

The controller also includes an anode current circuit 209. As described in detail below, the anode current circuit 209 interacts with the processor 201 to measure a current of the sacrificial anode 107 relative to the water tank 101 and to regulate the current such that the current is limited to a determined maximum current limit.

Figure 3:
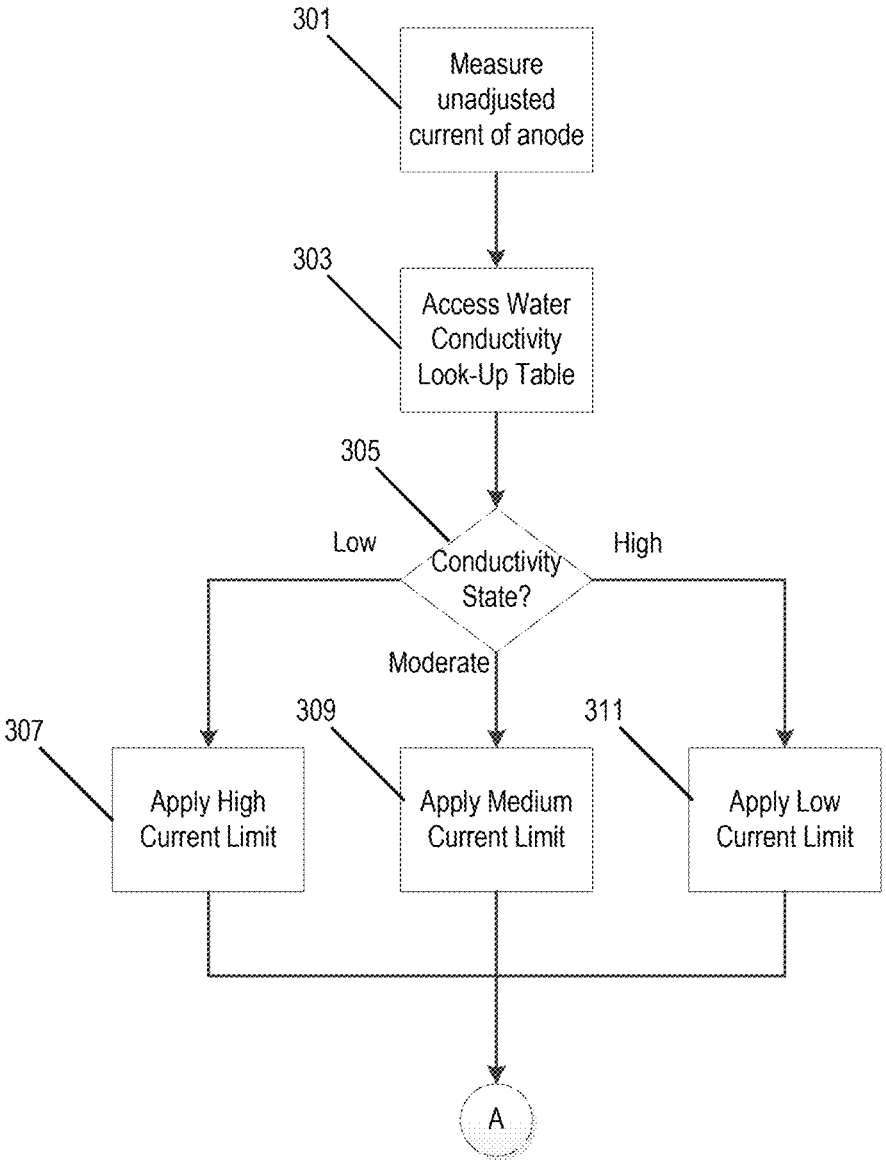
FIG. 3 is a flow-chart of a method for controlling the current of a sacrificial anode of the water heating system of FIG. 1 based on the conductivity state of the water in the tank.

FIG. 3 illustrates a method by which the controller 105 regulates the current of the sacrificial anode 107 based on the conductivity state of the water. The controller 105 first measures an unadjusted current of the anode (step 301). The unadjusted current of the anode 107 is the measured current of the anode 107 relative to the water tank 101 when no resistance or other current limiting functionality is applied to the anode 107. The controller 105 then accesses a water conductivity look-up table stored on the memory 203 of the controller 105.

Figures 4, 5:
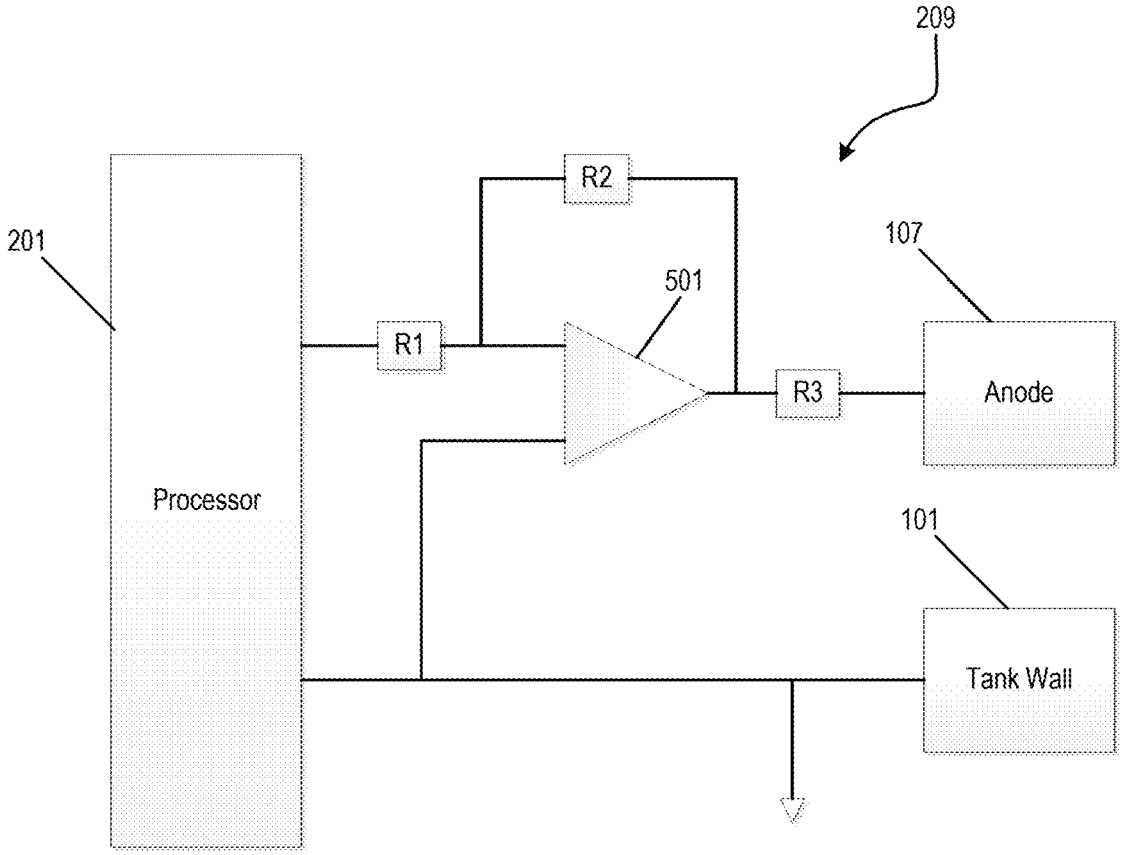
FIG. 4 is an example of a look-up table utilized in the method of FIG. 3 to determine the conductivity state of the water in the tank.
FIG. 5 is a block diagram of a current limiting circuit of the water heater controller of FIG. 2.

FIG. 4 illustrates one example of a look-up table for use in the water heating system 100. The look-up table lists a range of current values corresponding to each of a plurality of water conductivity states and each of a plurality of temperature ranges. The ranges defined by the look-up table are based on a number of current thresholds. In the example of FIG. 4, the look-up table is divided into three conductivity states: a low state where water conductivity is approximately 90 μS/cm, a moderate state where water conductivity is approximately 350 μS/cm, and a high state where water conductivity is approximately 1500 μS/cm. However, in other constructions, the specificity of the system can be increased by classifying the water conductivity according to a greater number of states.

Furthermore, to allow the same controller 105 and look-up table to be included in multiple different water heating system configurations, the look-up table can include additional dimensions. For example, the ranges of currents corresponding to a low, moderate, and high conductivity are defined based, not only on the temperature of the water, but also based on the geometry and composition of the water tank 101 and the sacrificial anode 107. However, instead of requiring measurements and analysis of the water tank 101 and the sacrificial anode, the controller 105 is configured to identify the water tank 101 and the sacrificial anode 107 in the look-up table based on a product model number assigned to the specific component. As such, the portion of the look-up table illustrated in FIG. 4 may correspond to a specific combination of tank 101 and anode 107. In a water heating system that includes a different tank and anode type, the current values corresponding to the low, moderate, and high conductivity state may be quite different from those listed in the portion of the look-up table illustrated in FIG. 4.

Returning now to FIG. 3, the controller 105 determines the conductivity state of the water based on the look-up table (step 305). The ranges of the current values in the look-up table of FIG. 4 corresponding to each conductivity state are based on a pair of current value thresholds—a first threshold separating a "low conductivity" range from a "moderate conductivity" range and a second threshold separating the "moderate conductivity" range from the "high conductivity" range. The controller 105 determines the appropriate conductivity state of the water in the tank 101 by comparing the measured unadjusted current of the anode to the two current thresholds.

If the measured unadjusted current is less than both thresholds, the controller 105 determines that the water in the tank 101 has low conductivity. In low conductivity water, a higher current is required to adequately protect the water tank 101 from corrosion. As such, the controller 105 defines the "maximum current limit" for the water heating system as a high current limit value (step 307). In some constructions, the controller 105 may even artificial apply a current to the anode from a power source to ensure that the current of the anode 107 is sufficient to protect the tank 101 from corrosion.

If the measured unadjusted current is greater than the first threshold, but lower than the second threshold, the controller 105 determines that the water in the tank 101 has moderate conductivity. The controller then defines the "maximum current limit" for the water heating system as a medium current limit value (i.e., a current value that is less than the current limit value for low conductivity water) (step 309). Similarly, if the measured unadjusted current is greater than both the first threshold and the second threshold, then the controller 105 determines that the water in the tank 101 has high conductivity and defines the "maximum current limit" for the water heating system 100 as a low current limit value (i.e., a current value that is less than the current limit value for both low conductivity and moderate conductivity water) (step 311).

Once the conductivity state of the water has been determined and the maximum current limit has been defined, the controller 105 regulates the current of the anode 107 using a current limiting circuit 209. FIG. 5 illustrates one example of a current limiting circuit 209 of controller 105. The wall of the tank 101 is grounded and connected to both the processor 201 and an operational-amplifier (op-amp) 501. This value serves as a reference for the current limiting functionality. The anode 107 is connected to the processor 201, the input of the op-amp 501, and the output of the op-amp 501 through a series of resistors R1, R2, and R3. The current limiting circuit 209 enables the processor to measure the current of the anode relative to the tank 101 (i.e., ground) and also limits the current of the anode 107 so that it does not exceed the determined maximum current limit for the water heating system 100. In alternative constructions, the anode current circuit 209 includes a variable resistor that is adjusted by the processor based on the measured current of the anode 107.

In the examples described above, the controller 105 determines a conductivity state of the water in the tank 101 and controls the current of the anode based on the conductivity state. However, the system described above also implements additional functionality to adjust the value of the determined maximum current limit for the water heating system 100 based on other variables such as, for example, the condition of the water and the tank 101.

Figure 6:
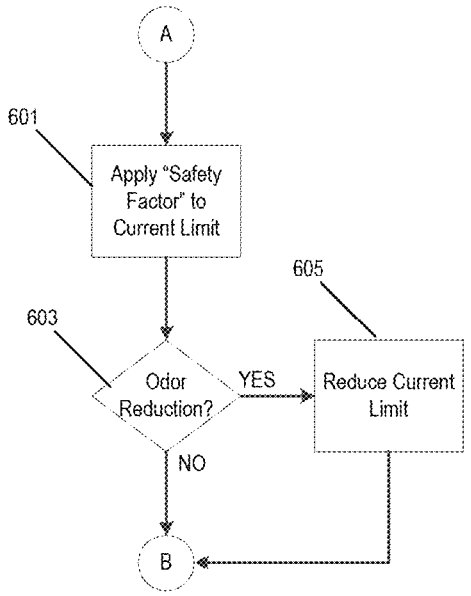
FIG. 6 is a flow-chart of a method for adjusting the maximum current limit of the water heating system to reduce odors in the water.

A negative side effect of using a sacrificial anode 107 to protection the tank 101 from corrosion is that, in some water conditions, excessive current can cause the water in the tank to have an unpleasant odor. FIG. 6 illustrates an example of how the controller 105 can adjust the determined maximum current limit to reduce odor. As described above, the controller 105 defines the maximum current limit for the water heating system 100 based on the conductivity state of the water. In some constructions, the maximum current limit is defined according to a calculation based on characteristics of the tank 101 and the water held inside the tank 101. However, in other constructions, the high, medium, and low values of the maximum current limit corresponding to each of the three conductivity states discussed above are constants that are stored on the memory 203. In some cases, the determined maximum current limit for the identified conductivity state of the water corresponds to a minimum current value required to protect the tank from corrosion offset by a safety factor. In some constructions, value of the safety factor is either added to the minimum current value required to protect the tank or multiplied by the minimum current value. For example, in some constructions, the safety factor is defined as "two" and, as a result, the determined maximum current limit for the identified conductivity state is double the minimum current value required to protect the tank from corrosion.

As illustrated in FIG. 6, the controller 105 determines the appropriate maximum current limit for the water heating system 100 by applying the safety factor to the current limit (step 601). The controller 105 then determines whether an "odor reduction mode" has been activated for the water heating system (step 603). In some constructions, the odor reduction mode is activated by a user through a switch or button on a user interface for the water heating system. In other cases, the odor reduction mode can be automatically activated by the controller 105 based on observed water conditions including, for example, the conductivity state of the water.

If the odor reduction mode is not activate (step 603), then the controller 105 continues to regulate the current of the anode based on the original maximum current limit (including the safety factor). However, if the odor reduction mode is activated, the controller 105 reduces the value of the current limit (step 605). For example, the controller 105 can remove the safety factor and regulate the current of the anode based only on the minimum current level required to protect the tank. Alternatively, the controller 105 can adjust the maximum current limit value such that the adjusted maximum current level falls between the original current limit value and the minimum required current.

Figure 7:
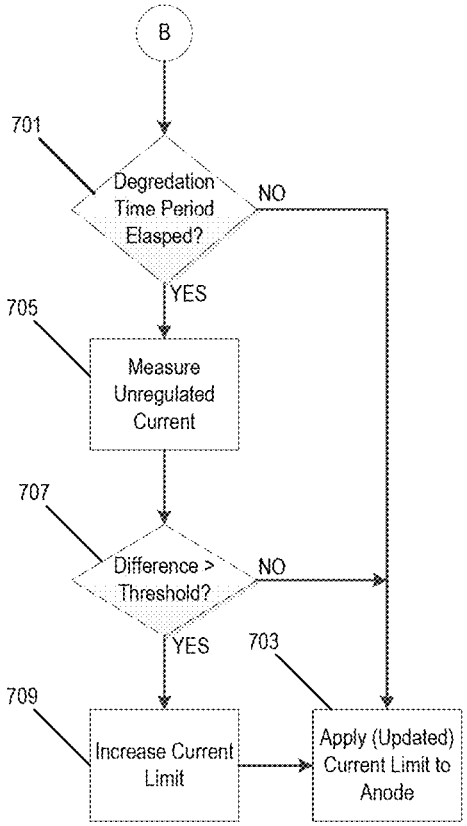
FIG. 7 is a flow-chart of a method of evaluating degradation of a water tank of the water heating system of FIG. 1.

Over time, the glass lining of the water tank 101 will wear away and, as noted above, the anode 107 itself will begin to degrade. As such, the anode current required to protect the tank from corrosion will generally increase over the life of the water heating system 100. FIG. 7 illustrates an example of how the determined maximum current level for the anode 107 can be adjusted to account for deteriorating hardware conditions of the water heating system 100.

The controller 105 begins by determining whether a degradation evaluation time period has elapsed (step 701). The controller 105 can be programmed to perform this evaluation periodically (e.g., once a month or once a year). If the degradation evaluation time period has not yet elapsed, the controller 105 continues regulating the current of the anode based on the determined maximum current limit (step 703). However, when the controller 105 determines that it is again time to evaluate the condition of the water heating system 100, the controller 105 removes the current limit applied to the anode 107 by the anode current circuit 209 and measures an unregulated current of the anode 107 (step 705).

Water heating systems are typically not relocated during the life of the water heating system 100 and the conductivity of water at a location will generally not change significantly over the same time period. Therefore, after the degradation evaluation time period has elapsed, any change in the measured unregulated current will be predominantly due to degradation of the water heating system 100. In the example of FIG. 7, the controller 105 compares the difference between the original unregulated current and the subsequent unregulated current to a degradation difference threshold (step 707). If the threshold is not exceeded, the controller 105 does not adjust the maximum current limit of the water heating system 100 and continues to regulate the anode current based on the previously determined maximum current limit (step 703). However, if the degradation threshold is exceeded, the controller 105 increases the value of the maximum current limit (step 709) and proceeds to regulate the anode current based on the increased maximum current limit (step 703).

When the degradation threshold is exceeded, the controller 105 can increase the current limit in a variety of ways. For example, the controller 105 can apply a higher safety factor to the maximum current limit. Alternatively, the controller 105 can adjust the maximum current limit based on the magnitude of the deviation between the original measured unadjusted current and the subsequent measured unadjusted current. Furthermore, in other constructions, the controller 105 increases the current limit based on changes to the measured unadjusted current regardless of whether a degradation threshold has been exceeded. In some such constructions, the value of the safety factor described above is directly related to the magnitude of the deviation between the original unadjusted current of the anode and a present value of the unadjusted current of the anode.

As noted above, although increasing the value of the maximum current limit increases the level of protection provided to the tank, it will also increase the rate of degradation of the sacrificial anode. Therefore, in some constructions, a maximum current limit set-point is defined for the anode 107 of the water heating system 100. The maximum current limit set-point can be defined as a current value that will cause the anode to degrade to the point of failure after a defined period of time. The maximum current limit set-point can be defined such that the defined period of time until failure of the anode correlates to the expected life of the water heater tank or, alternatively, a warranty period for the water heating system 100. Preventing the controller 105 from increasing the maximum current limit beyond the maximum current limit set-point ensures that the anode 107 remains operational for at least a known, defined period of time.

Thus, the invention provides, among other things, a system and method for regulating the current of a sacrificial anode based on a conductivity state of the water in a water heater tank to ensure adequate protection and reduce the rate of degradation of the sacrificial anode. Various features and advantages of the invention are set forth in the following claims.

What is claimed is:

1. A water heating system comprising:

a water tank;

a sacrificial anode protecting the water tank from corrosion; and a water heater controller, the water heater controller controlling including a processor and memory storing instructions that, when executed by the processor, cause the water heater controller to:

measure an unregulated current of the sacrificial anode relative to the water tank;

measure a temperature of the water in the water tank;

identify a current threshold based on the measured temperature of the water;

identify a conductivity state of water in the water tank based on the measured unregulated current by comparing the measured unregulated current to the identified current threshold;

determine a maximum current limit for the sacrificial anode based on the conductivity state of the water;

limit the current of the sacrificial anode so that the current of the sacrificial anode does not exceed the determined maximum current limit.

2. The water heating system of claim 1, wherein the instructions, when executed by the processor, further cause the water heater controller to identify the conductivity state of the water by identifying a conductivity state of the water based on the measured unregulated current and the measured temperature.

3. The water heating system of claim 2, wherein the instructions, when executed by the processor, further cause the water heater controller to identify a product model of the water tank and identify a product model of the sacrificial anode, and cause the water heater controller to identify the conductivity state of the water further by identifying a conductivity state of the water based on the measured unregulated current, the measured temperature, the product model of the water tank, and the product model of the sacrificial anode.

4. The water heating system of claim 1, wherein the instructions, when executed by the processor, cause the water heater controller to identify the conductivity state of the water by identifying the conductivity state as low when the measured unregulated current does not exceed a first current threshold, identifying the conductivity state as moderate when the measured unregulated current exceeds the first current threshold, but does not exceed a second current threshold, the second current threshold being greater than the first current threshold, and identifying the conductivity state as high when the measured unregulated current exceeds both the first current threshold and the second current threshold wherein at least one of a group consisting of the first current threshold and the second current threshold corresponds to the identified current threshold.

5. The water heating system of claim 4, wherein the instructions, when executed by the processor, further cause the water heater controller to access a look-up table stored on the memory; and identify the first current threshold and the second current threshold corresponding to the measured temperature of the water in the look-up table.

6. The water heating system of claim 5, wherein the instructions, when executed by the processor, further cause the water heater controller to identify a product model of the water tank, identify a product model of the sacrificial anode, and identify the first current threshold and the second current threshold corresponding to the product model of the water tank, the product model of the sacrificial anode, and the measured temperature of the water in the look-up table.

7. The water heating system of claim 1, wherein the determined maximum current limit is accessed from the memory and corresponds to a minimum current required to protect the water tank from corrosion multiplied by a safety factor.

8. The water heating system of claim 7, wherein the safety factor equals two and the determined maximum current limit corresponds to double the minimum current required to protect the water tank from corrosion.

9. The water heating system of claim 1, wherein the instructions, when executed by the processor, further cause the water heater controller to determine whether an odor reduction mode is activated; and when the odor reduction mode is activated, reduce the determined maximum current limit.

10. The water heating system of claim 9, wherein the determined maximum current limit is accessed from the memory and corresponds to a minimum current required to protect the water tank from corrosion multiplied by a safety factor, and wherein instructions, when executed by the processor, cause the water heater controller to reduce the determined maximum current limit by reducing the determined maximum current limit based on the safety factor such that the reduced determined maximum current limit is equal to the minimum current required to protect the water tank from corrosion.

11. The water heating system of claim 1, wherein the instructions, when executed by the processor, further cause the water heater controller to evaluate degradation of the lining of the water tank by storing an initial unregulated current value of the sacrificial anode relative to the water tank to the memory;

measuring a subsequent unregulated current value of the sacrificial anode relative to the water tank after a period of time has elapsed; and increasing the determined maximum current limit based on the difference between the initial unregulated current value and the subsequent unregulated current value.

12. The water heating system of claim 11, wherein the instructions, when executed by the processor, cause the water heater controller to increase the determined maximum current limit based on the difference between the initial unregulated current value and the subsequent unregulated current value by setting the determined maximum current limit to equal an increased determined maximum current limit when the difference between the initial unregulated current value and the subsequent unregulated current value exceeds a degradation threshold.

13. The water heating system of claim 11, wherein the determined maximum current limit is not increased beyond a maximum set-point current limit.

* * * * *